US008721505B2

(12) United States Patent
Conarty

(10) Patent No.: US 8,721,505 B2
(45) Date of Patent: May 13, 2014

(54) TRAINING ASSEMBLY

(76) Inventor: Brent Conarty, New Orleans, LA (US)

( * ) Notice: Subject to any disclaimer, the term of this patent is extended or adjusted under 35 U.S.C. 154(b) by 203 days.

(21) Appl. No.: 13/199,970

(22) Filed: Sep. 14, 2011

(65) Prior Publication Data

US 2013/0065735 A1 Mar. 14, 2013

(51) Int. Cl.
*A63B 69/28* (2006.01)
*A63B 69/30* (2006.01)

(52) U.S. Cl.
USPC ..... 482/89

(58) Field of Classification Search
USPC ..... 482/83–90; 473/138–149, 441–445; 273/440.1; 446/325, 396; 463/49–57
See application file for complete search history.

(56) References Cited

U.S. PATENT DOCUMENTS

| | | | | |
|---|---|---|---|---|
| 264,931 | A | 9/1882 | Cook | |
| 299,091 | A | 5/1884 | Rumsy | |
| 318,766 | A | 5/1885 | Longden | |
| 341,231 | A | 5/1886 | Goodman | |
| 426,944 | A * | 4/1890 | Lovatt | 482/89 |
| 1,685,495 | A * | 9/1928 | Latz | 482/89 |
| 4,721,302 | A * | 1/1988 | Murphy | 482/89 |
| 2004/0110607 | A1 | 6/2004 | Crespo | |
| 2010/0248908 | A1 | 9/2010 | Ramsay-Matthews | |

* cited by examiner

*Primary Examiner* — Oren Ginsberg
*Assistant Examiner* — Jennifer M Deichl
(74) *Attorney, Agent, or Firm* — Keaty Law Firm, LLC

(57) ABSTRACT

Training equipment includes a punch bag suspended on a tensioned flexible resilient suspension cord between two vertically spaced apart fixed points, such as an overhead point and the floor. A pair of stop members limits sliding movement of the punch ball along the suspension cord. A bounce member is secured between the stop member(s) and the punch ball to impart unpredictability to the movement of the punch ball during horizontal and vertical displacement of the ball following a punch or a kick by a trainee.

16 Claims, 5 Drawing Sheets

TRAINING ASSEMBLY

BACKGROUND OF THE INVENTION

This invention relates to sporting equipment and more particularly to training equipment comprising a strike object, such as a punching bag used in boxing or martial arts.

Punch bags are extensively used in boxing and martial arts training. A conventional punch ball uses a suspension strap that passes through the center. The strap is secured to the floor and the ceiling or door frame keeping the punch bag in a set vertical position, while allowing the bag to move laterally when punched or kicked by a sportsman. However, it is important for the athlete to develop skills of attacking different parts of the opponent's torso while the opponent is moving, bending and evading the strike. To this end, trainers often use padded gloves that the trainers move up or down causing the trainee to shift the direction of the blow. While such training method works satisfactory in many cases, it necessarily requires that there be a second person who works with the trainee at all times. Furthermore, the trainer's hand cannot withstand multiple blows by several trainees, which is why such method can hardly be used for an extended period of time.

The present invention contemplates elimination of drawbacks associated with conventional punch bags and provision of a punch bag that can be used in boxing and martial arts training and can be forced to move in a plurality of radial directions.

SUMMARY OF THE INVENTION

It is, therefore, an object of the present invention to provide a training assembly containing a punch bag suspended on flexible resilient suspension members and configured to move in a plurality of unpredictable directions between vertical and horizontal planes.

It is another object of the invention to provide a punch bag assembly that can be suspended from a ceiling and secured to a floor.

These and other objects of the invention are achieved through a provision of a training assembly, which comprises a punch bag suspended on a tensioned flexible resilient suspension cord between two vertically spaced apart fixed points, such as an overhead point and the floor. A pair of stop members limits sliding movement of the punch ball along the suspension cord. A bounce member is secured between the stop member(s) and the punch ball to impart unpredictability to the movement of the punch ball during horizontal and vertical displacement of the ball following a punch or a kick by a trainee. The bounce member can be in the form of a pair of flexible resilient cords attached to the upper stop member and the punch bag or a magnet assembly secured to the stop members and the punch bag.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
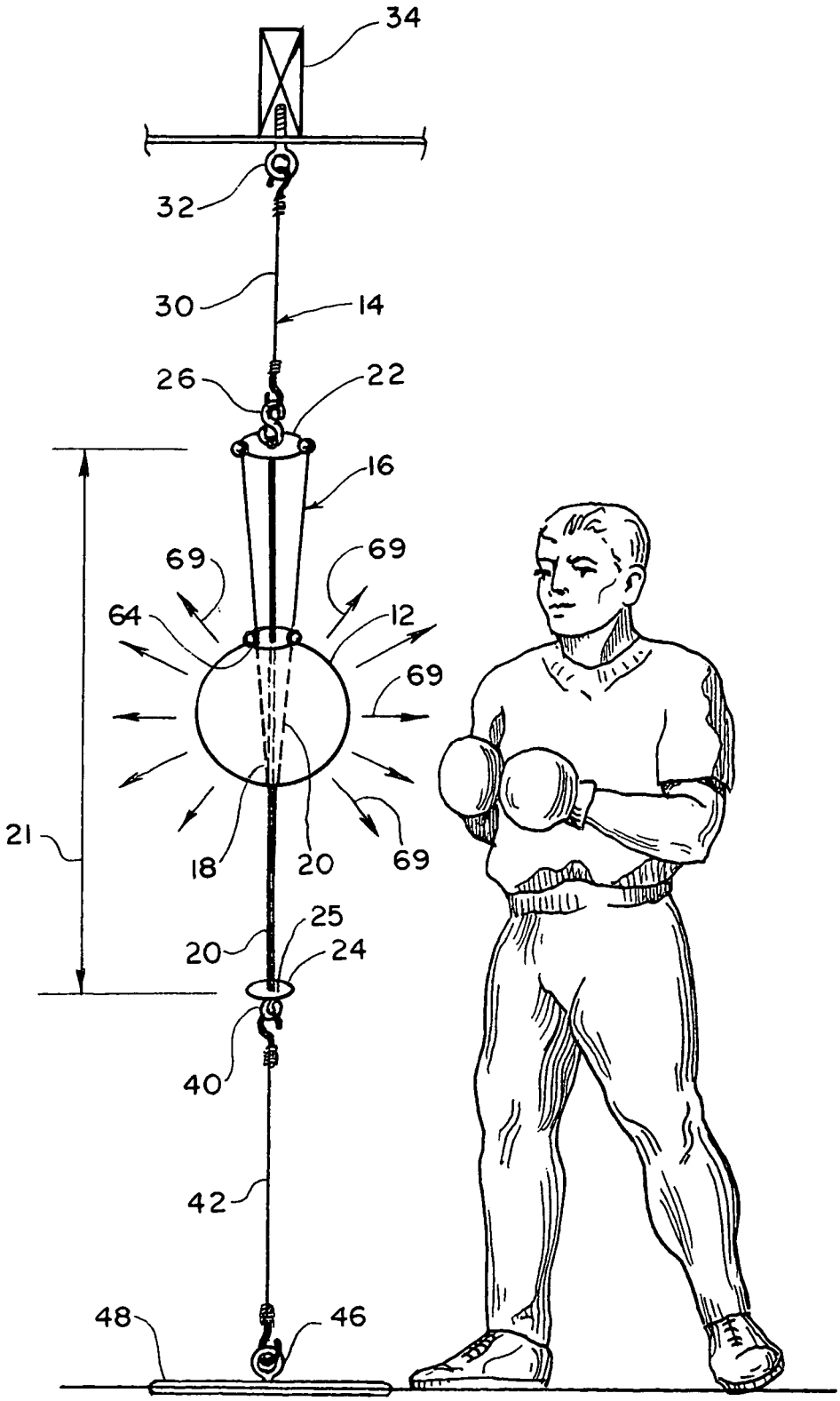
FIG. 1 is a perspective view of the training assembly according to the first embodiment of the present invention.

Turning now to the drawings in more detail, numeral 10 designates the training assembly according to this invention. The assembly 10 comprises a strike object 12, a means 14 for suspending the strike bag between two vertically spaced fixed points, and a bounce means 16 mounted between the suspending means and the strike object configured to increase unpredictability of movement of the strike object during vertical and horizontal displacement.

The strike object or punch bag 12 can be shaped in the form of a spherical body, a sack, a bag or in any other desired configuration. The punch bag 12 can be constructed as a hollow body composed of cloth, fabric, woven material, of natural or synthetic fibers, leather, and the like. The punch bag 12 can be filled with a suitable filling material, such as for instance seeds, beans, small plastic pellets, dense foam and others. The punch bag 12 is formed with a through opening 18 configured to receive a suspension cord 20. In the preferred embodiment of the invention, the suspension cord 20 is formed from a flexible resilient material. If desired, a flexible channel conduit can be positioned in the opening 18 to allow the suspension cord 20 to pass therethrough.

An upper stop member 22 and a lower stop member 24 limit the axial movement of the punch bag 12 along the suspension cord 20. In one aspect of the invention, the distance between the upper and lower stop member 22, 24 is about 3-4 feet. The upper stop member 22 and the lower stop member 24 are configured as circular or oval-shaped plates having a central opening. As a result, the punch bag 12 can move in a vertical direction, schematically shown by arrow 21, when punched or kicked by a trainee 100.

An upper end of the suspension cord 20 extends through a central opening 23 formed in the upper stop member 22. The upper end of the suspension cord 20 is detachably secured to an upper hook 26 above the upper stop member 22, as shown in detail in FIG. 2. An upper flexible resilient attachment cord 30 is secured to the upper hook 26 opposite and in a general alignment to, the upper end of the suspension cord 20. A free end of the upper attachment cord 30 is detachably secured to an upper attachment member 32, which can be a screw attachable to an overhead rigid support 34, such as a beam or a ceiling.

A lower end of the suspension cord 20 extends through a central opening 25 formed in the lower stop member 24. The lower end of the suspension cord is detachably secured to a lower hook 40, which is mounted below the lower stop member 24. A lower flexible resilient attachment cord 42 is secured to the lower hook 40 opposite and in general alignment to, the lower end of the suspension cord 20. A free end of the lower attachment cord 42 is detachably secured to a lower attachment member 46, which can be a screw attachable to a floor 48. In a stationary position, the suspension cord 20, the upper attachment cord 30 and the lower attachment cord 42 are tensioned between the rigid overhead support 34 and the floor 48.

Figure 2:
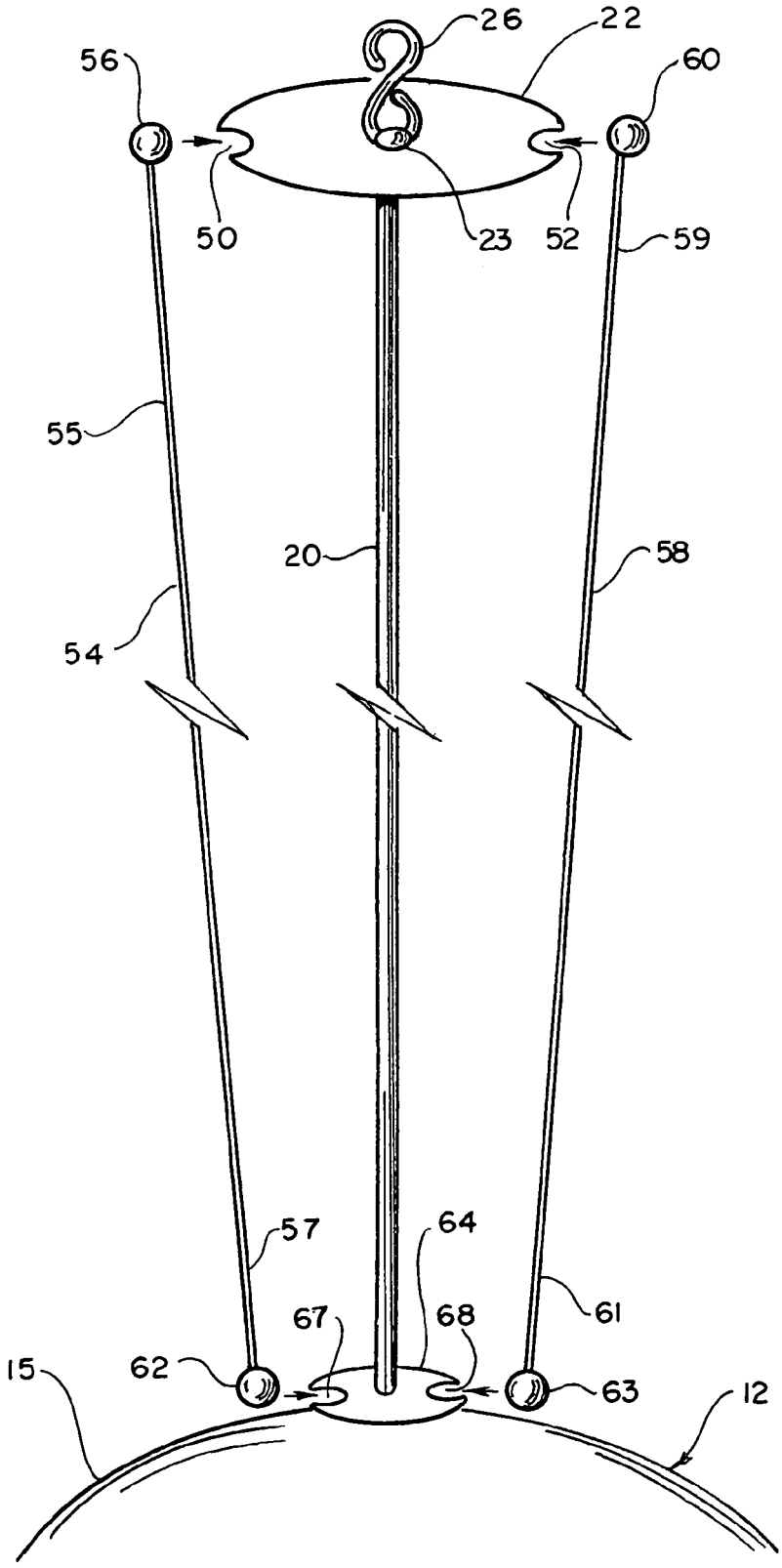
FIG. 2 is a detail view of the attachment tension members of the training assembly.

As can be seen in detail in FIG. 2, the upper stop member 22 is provided with a pair of diametrically opposite cutouts 50 and 52 formed in the peripheral edge of the upper stop member. In this embodiment, the bounce means comprises a first resilient flexible tension member 54 and a second flexible resilient tension member 58. The first tension member 54 has an upper part 55, which carries a top enlarged portion 56. The upper part 55 is configured for fitting into the cutout 50, with the top enlarged portion 56 being positioned above the upper stop member 22. A second resilient flexible tension member 58 has an upper part 59, which carries a top enlarged portion 60. The upper part 59 is configured for fitting into the second cutout 52, with the top enlarged portion 60 being positioned above the upper stop member 22. The enlarged top portions 56 and 60 have dimensions at least slightly greater than the dimensions of the cutouts 50, 52, respectively, such that the upper parts of the tensions members 54 and 58 are prevented from disengagement from the upper stop member 22.

A bottom tension stop 64 is mounted below the upper stop member 22 and is secured to an upper surface 15 of the punch bag 12. The bottom tension stop 64 is provided with two diametrically opposite grooves 67, 68, which are configured to detachably receive bottom parts 57 and 61 of the tension members 54 and 58, respectively. The bottom part 57 of the tension member 54 carries a bottom enlarged portion 62, and the bottom part 61 carries an enlarged bottom portion 63. The enlarged bottom portions 62, 63 have dimensions at least slightly greater than the dimensions of the cutouts 67, 68, respectively, such that the bottom parts of the tensions members 54 and 58 are prevented from disengagement from the bottom tension stop 64.

In one aspect of the invention, the bottom tension stop 64 has smaller dimensions than the upper stop member 22. As a result, the tension members 54, 58 extend at an angle to a longitudinal axis of the suspension cord 20, as well as longitudinal axes of the upper attachment cord 30 and the lower attachment cord 42.

In operation, the trainee 100 secures the punch bag between the upper support 34 and the floor 48 using the attachment members 32, 46 and attachment cords 30, 42. The user ensures that the tension members 54, 58 are taught or tensioned between the upper stop member 22 and the bottom tension stop 64. The user then begins training punching or kicking the punch bag 12 from a variety of angles. Since the punch bag 12 is free to move along the resilient suspension cord 20, while the tension members enhance the tension between the punch bag 12 and the attachment cords 30, 42. Depending on the strength of the punch and the surface area where the punch is delivered, the punch bag is displaced both horizontally and vertically; the punch bag moves in any of a plurality of radial directions both horizontally and vertically. The multiple directions of unpredictable movement of the strike object 12 are schematically illustrated by arrows 69 in FIG. 1.

Figure 3:
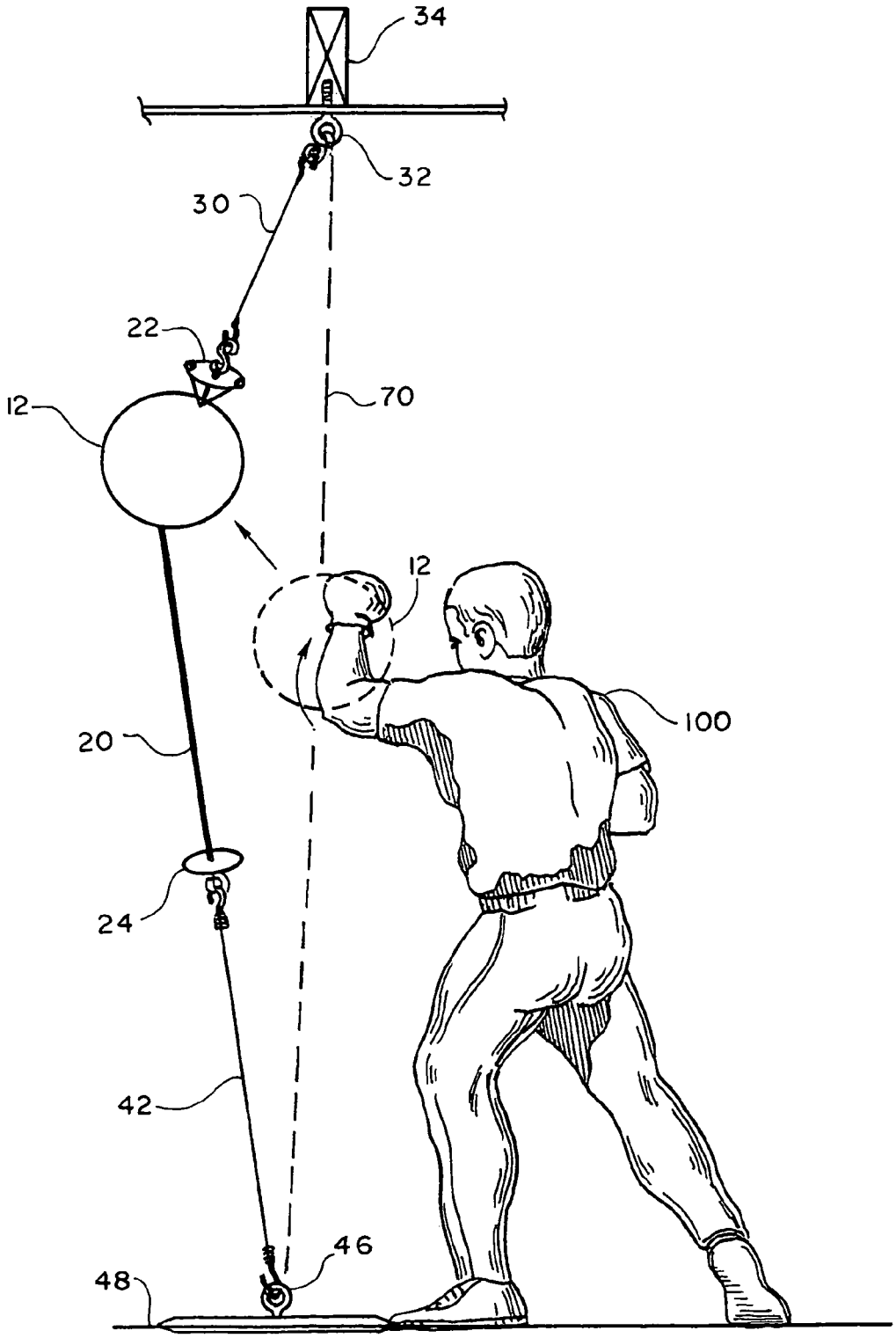
FIG. 3 illustrates a boxer punching the punch bag and causing it to move in a general upward direction while being displaced vertically and horizontally.
Figure 4:
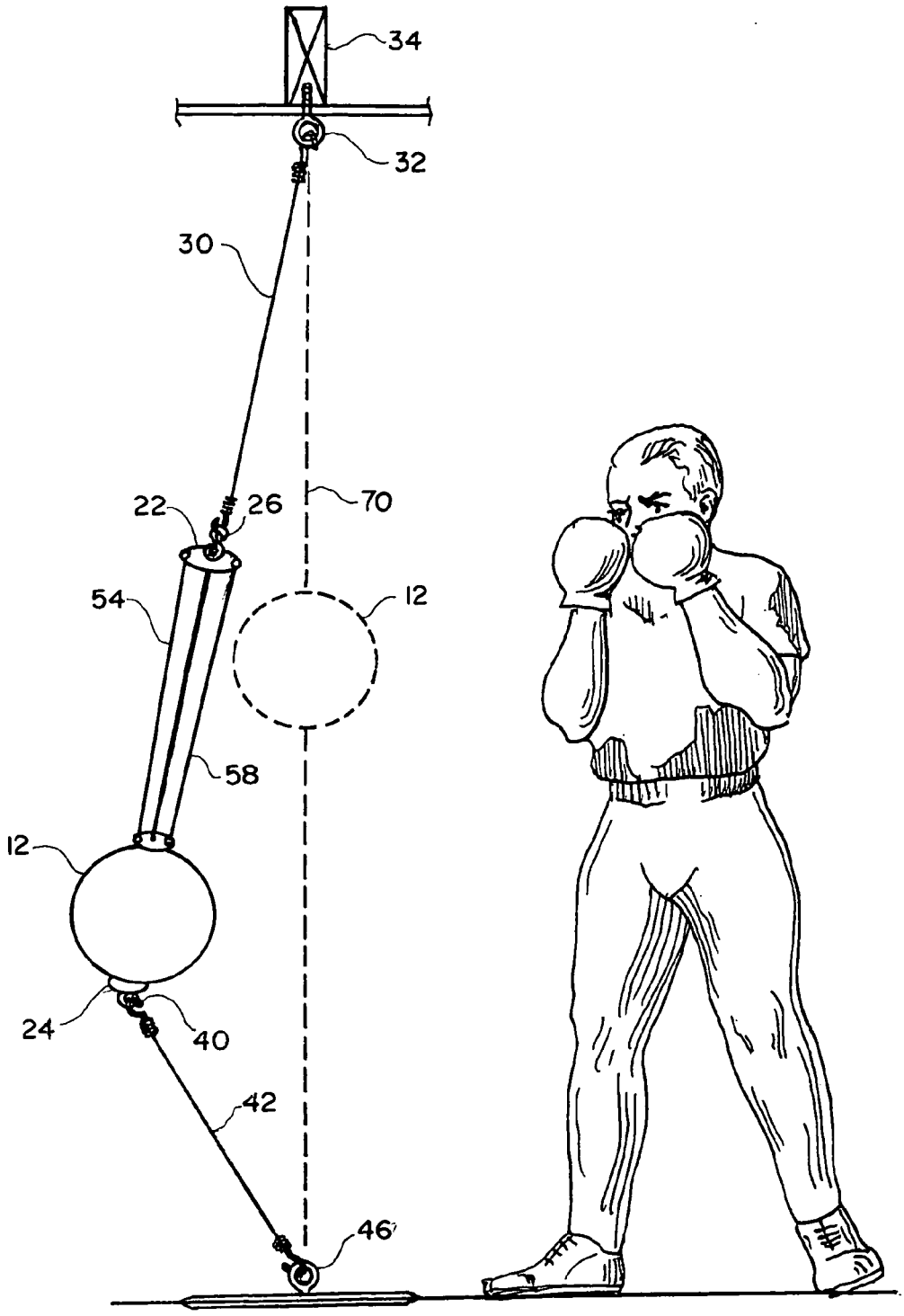
FIG. 4 illustrates a boxer punching the punch bag and causing it to move in a general downward direction while being displaced both vertically and horizontally.

FIGS. 3 and 4 illustrate movement of the punch bag depending on the direction of the strike delivered by the trainee 100 to the punch bag 12. In FIG. 3, the punch bag 12 moves upwardly from the original position shown in phantom lines, while at the same time moving at an angle to a vertical axis 70 due to resiliency of the suspension cord 20 and the tension members 54, 58. The tension cords 54, 58 contract temporarily bouncing the punch bag 12 upwardly. The upper stop member 22 prevents further sliding movement of the punch bag 12 along the suspension cord 20.

In FIG. 4, the trainee caused the punch bag 12 to move downwardly, stretching the suspension cord 20, as well as the tension members 54, 58. The punch bag 12 is limited in its downward sliding movement along the suspension cord 20 by the lower stop member 24. In this position, the punch bag 12 moves in a direction away from the original vertical axis 70. The bounce tension cords 54, 58 stretch moving the punch ball to a lower vertical position. Since the suspension cord, the attachment cords and the tension members are all pre-tensioned, the punch bag 12 will return to its normal vertical position shown in phantom lines in FIGS. 3 and 4, whereupon the trainee 100 will punch or kick the punch nag 12 numerous times during an exercise session.

Figure 5:
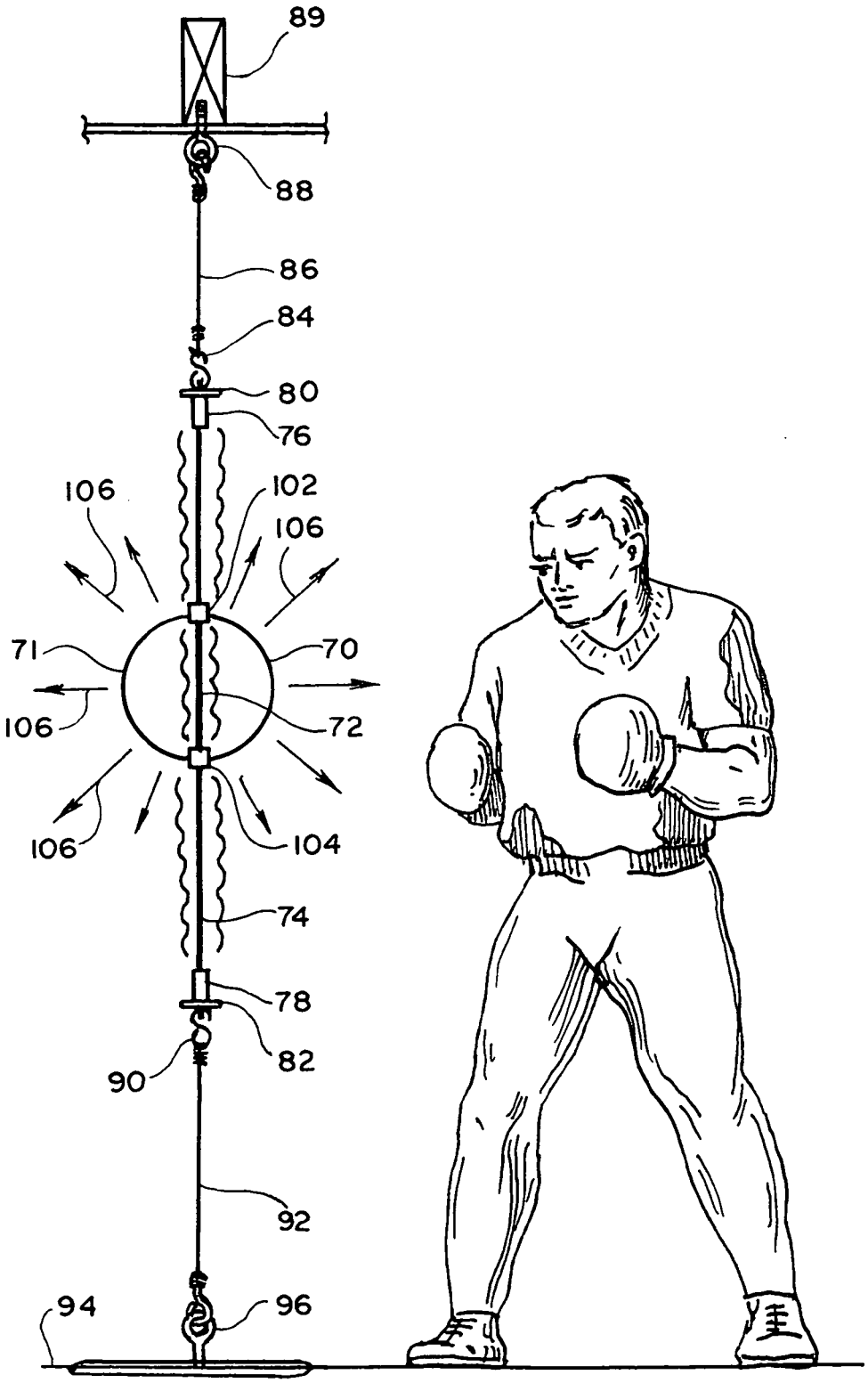
FIG. 5 is a perspective view of the second embodiment of the training assembly of the present invention using magnets.

FIG. 5 illustrates a second embodiment of the punch bag assembly of the present invention, where the bounce means is a plurality of magnet members secured to the suspension cord and the strike object. In this embodiment, a punch bag 70, similar to the punch bag 12 is formed with a central channel 72, through which a flexible resilient suspension cord 74 extends. The materials of construction of the punch bag 70 are similar to the materials used in the construction of the punch bag 12.

An upper end of the suspension cord 74 carries an upper magnet 76, and a lower end of the suspension cord 74 carries a bottom magnet 78. The upper magnet 76 is fixedly attached to an upper stop member 80, while the bottom magnet 78 is attached to a bottom stop member 82. An upper hook 84 is secured to the upper surface of the upper stop 80. An upper flexible resilient attachment cord 86 is secured to the upper hook 84, and a free end of the upper attachment cord 86 is attached to a top attachment member 88. The top attachment member 88 can be screw configured for attachment to an overhead support such as a beam 89 or a ceiling. A bottom hook 90 is secured to the bottom stop member 82, and a flexible resilient bottom attachment cord 92 is tensioned between the bottom hook 90 and the floor 94. A bottom attachment member 96 is secured to the floor 92 and the bottom flexible resilient attachment cord 92. The upper end of the bottom attachment cord 92 is secured to the bottom hook 90.

A first bag magnet 102 is attached to an upper surface 71 of the punch bag 70. The first bag magnet can be formed as a ring magnet allowing extension of the suspension cord 72 through a central opening thereof. A second bag magnet 104 is secured to a bottom surface 73 of the punch bag 70. The second bag magnet 104 is similar to the first bag magnet in configuration and allows the suspension cord 74 to pass through an opening formed therein.

The upper magnet 76 is mounted opposite the first bag magnet 102; the magnets 76 and 102 are oriented with the ends having opposite polarities. When the trainee 100 delivers an upward punch or kick to the punch bag 70, the punch bag 70 moves upwardly along the suspension cord 74 assisted by the attraction of the magnets 76 and 102. Similarly, the bottom magnet 78 and the second bag magnet 104 are mounted opposite each other with the ends having different polarities. When the user delivers a downward punch or kick to the punch bag 70, the punch bag 70 slides along the suspension cord 74 assisted by attraction of the magnets 104 and 78. As the punch bag slides along the suspension cord it bounces up, down and sideways under the influence of the magnetic field created by the magnet assembly.

Depending on the direction of the punch or kick the punch bag 70 can move in a plurality of radial directions schematically shown by arrows 106 in FIG. 5. Due to resiliency of the suspension cord 70 the punch bag 70 will always return to its original generally vertical orientation shown in FIG. 5.

The punch bag assembly of the present invention is fully portable. It is envisioned that the punch bag assembly of the instant invention cab be used in a variety of training facilities, including gymnasiums, home exercise rooms, outdoors, etc. as long as rigid supports can be found for the bottom and top attachments. The punch bag is allowed to move along unpredictable paths and offers unpredictable vertical and horizontal target movement, as well as a variety of radial movements along various planes between the strictly and strictly horizontal. This allows the trainees an opportunity to practice on a target that travels at varied heights and angles.

The lower attachment members are designed to be secured to a ground level fixed point. Although the drawings illustrate them secured to a floor, the term "ground level" as used herein includes also ground, or soil and is not limited to the floor of a building. The training assembly can be used outdoors as well, when the "ground level" is a lawn, cemented area, etc. A stake can be driven into the ground or the cemented area, and the bottom end of the lower attachment members can be secured thereto. The stop members can be formed as rectangular or square plates, of desired.

Many other changes and modifications can be made in the design of the present invention without departing from the spirit thereof. I, therefore pray that my rights to the present invention be limited only by the scope of the appended claims.

I claim:

1. A training assembly, comprising:

a strike object comprising a punch bag;

a means for suspending the strike object between two vertically spaced fixed points, said strike object being configured for a limited slidable movement along the means for suspending, the means for suspending comprising a flexible resilient suspension cord extending through the strike object and tensioned between the two vertically spaced fixed points, an upper stop member secured to the suspension cord above the strike object and a spaced-apart lower stop member secured to the suspension cord below the strike object; and a bounce member secured to the means for suspending and the strike object, said bounce member being adapted to facilitate unpredictable movement of the strike object during vertical and horizontal displacement of the strike object, wherein the bounce member comprises an upper magnet member fixedly secured to the upper stop member, a lower magnet member fixedly secured to the lower stop member, a first bag magnet secured to a top portion of the punch bag, and a second bag magnet secured to a bottom portion of the punch bag.

2. The assembly of claim 1, wherein the upper magnet member and the first bag magnet have facing ends with opposite polarity.

3. The assembly of claim 1, wherein the lower magnet member and the second bag magnet have facing ends with opposite polarity.

4. A training assembly, comprising:

a punch bag;

a means for suspending the punch bag between two vertically spaced fixed points, said punch bag being configured for a limited slidable movement along the means for suspending, said means for suspending comprising a flexible resilient suspension cord extending through the punch bag and tensioned between the two vertically spaced fixed points, an upper stop member secured to the suspension cord above the punch bag and a spaced-apart lower stop member secured to the suspension cord below the punch bag;

an upper attachment member secured to an upper end of the suspension cord and a lower attachment member secured to a lower end of the suspension cord, a free end of the upper attachment member being configured for securing to an overhead fixed object, and a free end of the lower attachment member being configured for securing to a ground level fixed point; and a bounce member secured to the means for suspending and the punch bag, said bounce member being adapted to facilitate unpredictable movement of the punch bag during vertical and horizontal displacement of the punch bag, wherein the bounce member comprises an upper magnet member fixedly secured to the upper stop member, a lower magnet member fixedly secured to the lower stop member, a first punch bag magnet secured to a top portion of the punch bag, and a second punch bag magnet secured to a bottom portion of the punch bag.

5. The assembly of claim 4, wherein the upper magnet member and the first punch bag magnet have facing ends with opposite polarity.

6. The assembly of claim 4, wherein the lower magnet member and the second punch bag magnet have facing ends with opposite polarity.

7. A training assembly, comprising:

a strike object;

a tensioned flexible resilient means for suspending the strike object between two vertically spaced fixed points, said strike object being configured for a limited slidable movement along the means for suspending; and a bounce member secured to the means for suspending and the strike object, said bounce member being adapted to facilitate unpredictable movement of the strike object during vertical and horizontal displacement of the strike object, said bounce member comprises a magnet assembly mounted between the means for suspending and the strike object.

8. The assembly of claim 7, wherein the strike object is a punch bag.

9. The assembly of claim 8, wherein the means for suspending comprises a flexible resilient suspension cord extending through the punch bag and tensioned between the two vertically spaced fixed points, an upper stop member secured to the suspension cord above the punch bag and a spaced-apart lower stop member secured to the suspension cord below the punch bag.

10. The assembly of claim 9, wherein said magnet assembly comprises an upper magnet fixedly secured to the upper stop member, a lower magnet member fixedly secured to the lower stop member, a first bag magnet secured to a top portion of the punch bag, and a second bag magnet secured to a bottom portion of the punch bag.

11. The assembly of claim 10, wherein the upper magnet member and the first bag magnet have facing ends with opposite polarity.

12. The assembly of claim 10, wherein the lower magnet member and the second bag magnet have facing ends with opposite polarity.

13. A method of training striking and kicking movements, comprising the steps of:

providing a punch bag;

providing a flexible resilient suspension cord configured for extending through the punch bag, while allowing a limited sliding movement of the punch bag along the suspension cord;

providing an upper stop member on the suspension cord and a lower stop member on the suspension cord, said upper stop member and said lower stop member defining limits of punch bag travel along the suspension cord;

providing a bounce member between the suspension cord and the punch bag, the bounce member comprising a magnet assembly secured to the upper stop member, the lower stop member and the punch bag;

tensioning the suspension cord between two vertically spaced fixed points;

imparting a punch or kick on the punch bag and causing vertical and horizontal displacement of the punch bag.

14. The method of claim 13, wherein the magnet assembly comprises an upper magnet member secured to the upper stop member, a first punch bag magnet secured to an upper portion of the punch bag, a lower magnet member secured to the lower stop member, and a second punch bag magnet secured to a lower portion of the punch bag.

15. The method of claim 14, wherein the upper magnet member and the first punch bag magnet have facing ends with opposite polarity.

16. The method of claim 14, wherein the lower magnet member and the second punch bag magnet have facing ends with opposite polarity.

* * * * *